US006164066A

United States Patent [19]

Sakaguchi et al.

[11] Patent Number: 6,164,066

[45] Date of Patent: Dec. 26, 2000

[54] MUFFLER FOR INTERNAL COMBUSTION ENGINE

[75] Inventors: Yukio Sakaguchi, Saitama; Takayuki Yamamoto, Tokyo; Shigeru Sato, Saitama, all of Japan

[73] Assignee: Kioritz Corporation, Tokyo, Japan

[21] Appl. No.: 09/234,574

[22] Filed: Jan. 21, 1999

[30] Foreign Application Priority Data

Jan. 27, 1998 [JP] Japan ..... 10-014246

[51] Int. Cl.[7] ..... F01N 3/10

[52] U.S. Cl. ..... 60/302; 60/308; 60/307; 60/304; 181/262; 181/231; 252/462

[58] Field of Search ..... 60/302, 308, 307, 60/304; 181/262, 231; 252/462

[56] References Cited

U.S. PATENT DOCUMENTS

| | | | |
|---|---|---|---|
| 3,976,599 | 8/1976 | Whelan | 252/462 |
| 5,338,903 | 8/1994 | Winberg . | |
| 5,431,013 | 7/1995 | Yamaki et al. . | |
| 5,521,339 | 5/1996 | Despain et al. | 181/230 |
| 5,738,184 | 4/1998 | Masuda et al. . | |
| 5,857,327 | 1/1999 | Sato et al. | 60/302 |

FOREIGN PATENT DOCUMENTS

| | | | |
|---|---|---|---|
| 406066137A | 3/1994 | Japan | 60/302 |
| 406248939A | 9/1994 | Japan | 60/302 |
| 409158722A | 9/1994 | Japan | 60/302 |

*Primary Examiner*—Thomas Denion
*Assistant Examiner*—Thai-Ba Trieu
*Attorney, Agent, or Firm*—Baker Botts L.L.P.

[57] ABSTRACT

A muffler for an internal combustion engine has a vertically elongated expansion chamber into which an exhaust gas from the exhaust port of internal combustion engine is introduced. The expansion chamber is separated level-wise into a first expansion chamber and a second expansion chamber by a partition plate. An exhaust emission purifier formed of an oxidation catalyst is attached to the partition plate, thereby allowing the exhaust gas ejected from the exhaust port to be introduced into the second expansion chamber from the first expansion chamber via the exhaust emission purifier. The exhaust emission purifier is spaced apart from the exhaust port by a predetermined distance in a direction orthogonal to an ejecting direction of the exhaust gas.

6 Claims, 8 Drawing Sheets

MUFFLER FOR INTERNAL COMBUSTION ENGINE

BACKGROUND OF THE INVENTION

The present invention relates to a muffler for an internal combustion engine, such as a small air-cooled two-stroke gasoline engine which is suited for use in small, portable working machines such as a bush cutter or a chain saw, and in particular to a muffler which is capable of complying with exhaust gas regulations.

In view of the recent increasing concerns about environmental problems, reductions in the amounts of HC, CO, NOx, etc. in the exhaust gas discharged from an engine are now strongly requested, even for a small air-cooled two-stroke gasoline engine to be used in a small, portable working machine such as a bush cutter or a chain saw. For example, as seen in the exhaust gas control bill in California, known as CARB TIER2, it is expected that exhaust gas regulations will become increasingly severe.

With a view to complying with such an exhaust gas regulation, the assignee of the present patent application has previously proposed in Japanese Patent Unexamined Publication H9-273416 a muffler having the following construction. The muffler is provided with an expansion chamber in which an exhaust gas ejected from the exhaust port of the engine is introduced. The expansion chamber is separated side by side by means of a partition plate into a first expansion chamber and a second expansion chamber. The partition plate is provided with an exhaust emission purifier, such as an oxidation catalyst, which is composed of a metallic foamed body having gas-permeability. Accordingly, an exhaust gas is introduced initially into the first expansion chamber and then passes through the exhaust emission purifier to the second expansion chamber.

Japanese Patent Unexamined Publicatior. H9-273416 also discloses a muffler wherein, in addition to the above-described construction, the outer wall of the expansion chamber is formed of a double wall consisting of an inner panel and an outer wall panel, which are spaced apart from each other by a suitable distance so as to form an air space therebetween.

Although the muffler proposed in Japanese Patent Unexamined Publication H9-273416 has been shown to significantly reduce THC components contained in an exhaust gas, it has been found by the present inventors that the aforementioned muffler is accompanied with the following problems.

As shown in FIG. 1 of the Japanese Patent Unexamined Publication H9-273416, the expansion chamber of the muffler is generally elongated in the direction orthogonal to the axial direction of the cylinder of the internal combustion engine, and the expansion chamber is separated side by side (laterally) by means of a partition plate into a first expansion chamber and a second expansion chamber. In other words, the expansion chamber is partitioned laterally of the ejecting direction of exhaust gas from the exhaust port of the engine, so that the exhaust gas is radially ejected from the exhaust port into the first expansion chamber. As a result, part of the ejected exhaust gas which is flowing downward cannot be dispersed by the inner wall of the first expansion chamber, thus causing this portion of exhaust gas to directly impinge against an upper portion of the exhaust emission purifier and then to pass through the exhaust emission purifier (oxide catalyst) from the first expansion chamber, while being directed in the same direction as (or in parallel with) the ejecting direction of the exhaust gas, into the second expansion chamber.

As a result, the temperature distribution of the inlet side of the exhaust emission purifier (or the first expansion chamber side) becomes non-uniform, thereby making it impossible to optimize the temperature of this region as a whole for the activation of the purifier. Furthermore, depending on the location of the exhaust emission purifier, not only the outlet temperature of the exhaust gas but also the surface temperature of the muffler may become excessively high due to the heating of the exhaust emission purifier, thus accelerating in the deterioration of the exhaust emission purifier or impairing the durability of the exhaust emission purifier.

BRIEF SUMMARY OF THE INVENTION

The present invention has been made to eliminate the aforementioned problems, and therefore an object of the present invention is to provide a muffler for an internal combustion engine, which is (1) capable of preventing the exhaust gas ejected from the exhaust port of an internal combustion engine from directly impinging against the exhaust emission purifier due to poor dispersion of the exhaust gas, (2) capable of making the temperature distribution on the inlet side of the exhaust emission purifier more uniform as a whole so as to optimize the temperature of this region for the activation of the exhaust emission purifier, and (3) capable of lowering not only the outlet temperature of the exhaust gas but also the surface temperature of the muffler that might otherwise be caused to increase due to the heating of the exhaust emission purifier, thus minimizing the deterioration of the exhaust emission purifier and enhancing the durability of the exhaust emission purifier.

With a view to attaining the aforementioned objects, a muffler for an internal combustion engine, according to the present invention, has an expansion chamber into which an exhaust gas ejected from the exhaust port of an internal combustion engine is introduced, that is divided level-wise relative to a longitudinal axis of the cylinder of the internal combustion engine into a first expansion chamber and a second expansion chamber by means of a partition plate. An exhaust emission purifier, such as an oxidation catalyst, is attached to the partition plate. Exhaust gas ejected from the exhaust port is introduced into the second expansion chamber from the first expansion chamber via the exhaust emission purifier.

According to a preferred embodiment of the present invention, the expansion chamber is elongated in a direction parallel to the longitudinal axis of the cylinder, and the exhaust emission purifier is spaced apart from the exhaust port by a predetermined distance in a direction orthogonal to an ejecting direction of the exhaust gas.

In another preferred embodiment of the present invention, said second expansion chamber is defined by an outer wall panel that has a discharge port for the exhaust gas, the discharge port being covered on the inside by a container-like inner space-forming member, thereby allowing the exhaust gas introduced into the second expansion chamber to be discharged to outer atmosphere through an outlet port formed in the inner space-forming member and through the discharge port. The discharge port is also covered by a spark arrester screen.

In mufflers for internal combustion engines according to the present invention, the exhaust gas ejected from the exhaust port of the internal combustion engine is introduced into the first expansion chamber at a high speed almost equivalent to the sonic velocity and the exhaust gas thus introduced into the first expansion chamber is expanded and diffused in the first expansion chamber, thereby attenuating the exhaust sound. In this case, almost the entire quantity of exhaust gas that has been ejected into the first expansion chamber is caused to impinge against the outer wall panel portion defining the first expansion chamber that is opposite to the exhaust port, and the exhaust gas thus impinged is then directed, almost in a uniform state, toward the inlet portion of the exhaust emission purifier.

Accordingly, it is possible to prevent the exhaust gas ejected from the exhaust port of the internal combustion engine from directly impinging against the exhaust emission purifier and to uniformly introduce all of the exhaust gas toward the inlet side of the exhaust emission purifier. Further, since the expansion chamber consisting of the first expansion chamber and the second expansion chamber is elongated, the degree of freedom in the arrangement of the exhaust emission purifier can be increased. Also, since the exhaust emission purifier is located remotely from the exhaust port by a predetermined distance in a direction orthogonal to an ejecting direction of the exhaust gas from the exhaust port, the exhaust emission purifier can be positioned at an optimal location. As a result, the temperature distribution of the inlet side of the exhaust emission purifier can be made uniform and, at the same time, the temperature thereof can be made optimal for the activation of the exhaust emission purifier. Moreover, since the exhaust emission purifier can be positioned at an optimal location, it is possible to lower not only the outlet temperature of the exhaust gas but also the surface temperature of the muffler that might otherwise be caused to increase due to the heating of the exhaust emission purifier, thus minimizing the deterioration of the exhaust emission purifier and enhancing the durability of the exhaust emission purifier.

The exhaust gas introduced into the first expansion chamber is then introduced, via the exhaust emission purifier that is mounted in the partitioning member, into the second expansion chamber owing to a difference in pressure between the first expansion chamber and the second expansion chamber, which second expansion chamber is arranged next to the first expansion chamber with the partitioning member being interposed.

In this case, since the exhaust gas is allowed to react (oxidative combustion) effectively with the oxygen in the expansion chamber due to the effect of the exhaust emission purifier (oxidation catalyst), the CO and HC components contained in the exhaust gas can be greatly reduced.

The exhaust gas introduced into the second expansion chamber is caused to expand and disperse again, thereby further attenuating the exhaust gas noise, and then (discharged to the outside atmosphere, according to preferred embodiments, after passing through the outlet port formed in the inner space-forming member and the discharge port covered by the spark arrester screen. Since the inner space-forming member and the spark arrester screen are arranged in this manner, even if a spark is left unextinguished in the second expansion chamber, it is possible to completely prevent the spark from being directly discharged outside, and at the same time, the temperature of the exhaust gas being discharged to the outer atmosphere can be further lowered. As a result, the durability of the spark arrester screen can be improved and at the same time, the clogging of the spark arrester screen can be minimized.

DESCRIPTION OF THE EMBODIMENTS

Figure 1:
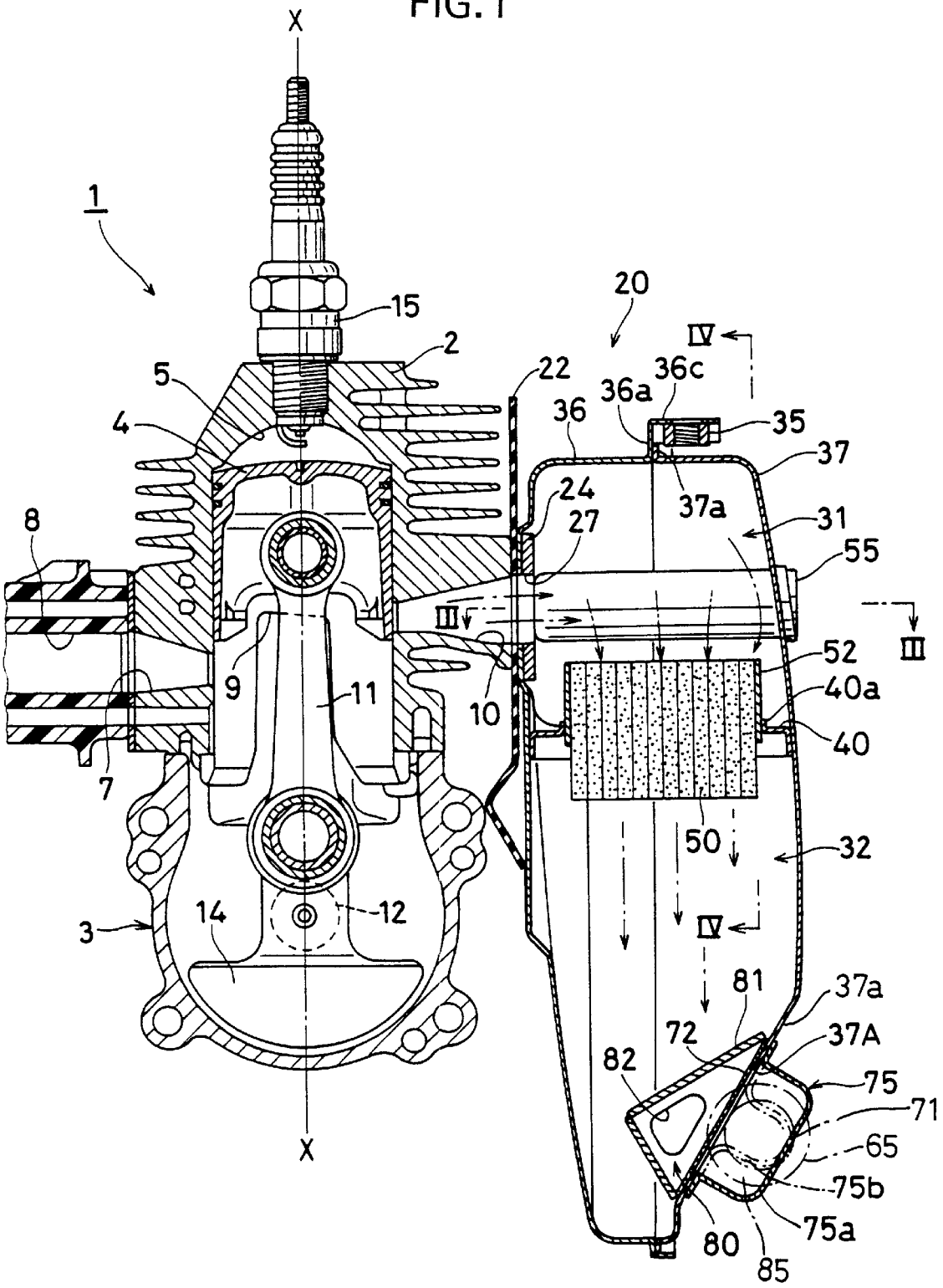
FIG. 1 is a longitudinal cross-sectional view illustrating one embodiment of a muffler according to the present invention, together with an internal combustion engine to which the muffler is attached.

In the first embodiment, as shown in FIG. 1, an internal combustion engine 1 is a small air-cooled two-stroke gasoline engine of Schnuerle scavenging type (hereinafter referred to simply as an internal combustion engine), which is usually used as a power source in a portable working machine such as a bush cutter or a chain saw, the displacement thereof being about 23 cc to 26 cc.

The engine 1 includes a cylinder 2 having a semi-spherical combustion chamber 5 provided with an ignition plug 15, a crank case 3 disposed below and in communication with the cylinder 2, a piston 4 movably received in the cylinder 2, an intake port 7 communicating with an air-fuel mixture-feeding passages 8, an exhaust port 10 communicating with a muffler 20 in a predetermined manner as explained hereinafter, and a pair of scavenging ports 9, which are located on the front and rear sides as viewed in FIG. 1, respectively (only one of them is shown in FIG. 1), in a predetermined manner.

In the same manner as in the ordinary internal combustion engine, the reciprocating up-and-down motion of the piston 4 is converted by a connecting rod 11 into a rotational motion of the crank shaft 12, which is provided with a balance weight 14. The shaft output portion is connected to and drives the aforementioned portable working machine.

The vertically elongated muffler 20, according to the first embodiment, is mounted on the outside portion of the exhaust port 10 of the cylinder 2 of the internal combustion engine 1 with its longer dimension parallel to the longitudinal axis X—X of the cylinder 2 of the internal combustion engine 1. A heat-insulating plate 22 is interposed between the muffler 20 and the engine 1. The muffler 20 is provided with a first expansion chamber 31 and a second expansion chamber 32 which are partitioned level-wise by means of a partitioning member 40 arranged approximately horizontally (in the lateral direction or the width-wise direction of the internal combustion engine 1).

The first expansion chamber 31 and the second expansion chamber 32 are defined by a pair of outer wall panels 36 and 37 whose facing sides are opened respectively. The outer peripheral edge portion 36*a* of the outer wall panel 36 disposed closer to the internal combustion engine 1 and the outer peripheral edge portion 37*a* of the outer wall panel 37 disposed remote from the internal combustion engine 1 are hermetically bonded to each other by means of, for example, welding. Further, the partitioning member 40 is hermetically bonded to the inner surfaces of the outer wall panels 36 and 37 in such a manner that the space formed by the outer wall panels 36 and 37 is partitioned into an upper space and a lower space, thereby defining the first expansion chamber 31 and the second expansion chamber 32, respectively.

The outer peripheral edge portion 36*a* of the outer wall panel 36 adjacent the internal combustion engine 1 is shaped into a flange of "L" shape in cross-section. As clearly shown in FIG. 2, widened portions 36*c* of the flange have a bolt-receiving holes 36*d* at the upper central portion as well as at the lower right and left portions of the L-shaped portion. Further, a nut 35 for mounting a muffler cover (not shown) is attached by means of welding to the reverse side of each of the widened portions 36*c*.

A prismatic oxidation catalyst 50 comprising a metallic carrier and serving as an exhaust emission purifier is mounted on the partitioning member 40 in such a manner that the prismatic oxidation catalyst 50 vertically penetrates the partitioning member 40, i.e., the prismatic oxidation catalyst 50 protrudes into the first expansion chamber 31 as well as into the second expansion chamber 32. In particular, a rectangular catalyst-mounting opening 40*a* is formed in the partitioning member 40, and a square tubular shell 52 is inserted into the catalyst-mounting opening 40*a* and fixed to the partitioning member 40 by means of welding, for instance. The prismatic oxidation catalyst 50 comprising a metallic carrier is inserted into and fixed to the shell 52 in such a manner that the upper surface (inlet side) of the oxidation catalyst 50 is exposed to the first expansion chamber 31, while the lower surface (outlet side) of the oxidation catalyst 50 is exposed to the second expansion chamber 32.

Since the oxidation catalyst 50, which may be formed integrally with the shell 52, is mounted so as to be supported by the partitioning member 40, the shape of the oxidation catalyst can be made simple and at the same time changes in size and location of the oxidation catalyst as well as the exchange and addition of the oxidation catalyst can be easily performed. Further, the partitioning member 40 and the oxidation catalyst 50 can be located away from the exhaust port 10 by a predetermined distance in a direction orthogonal to an ejecting flow direction of the exhaust gas.

As for the oxidation catalyst, it is not limited to the metallic carrier attached to the square tubular shell, but any mother configurations of oxidation catalyst can be employed.

As may be seen from FIGS. 1, 2, 3 and 4, a pair of fastening sleeves 55 are laterally disposed in the first expansion chamber 31 at almost the same level as that of the exhaust port 10 of the internal combustion engine 1 or as that of an exhaust gas inlet port 27 in a manner to interconnect the outer wall panel 37 with a reinforcing plate 24. Therefore, when the muffler 20 is to be attached to the outer side portion of the cylinder 2, a pair of bolts 56 are respectively introduced from the right side of the muffler 20 into the fastening sleeves 55, and then the tip portion of external thread is caused to engage with the internal thread (not shown) formed in the outer side portion of the cylinder 2, thus firmly fastening the muffler 20 to the cylinder 2.

As may be seen from FIGS. 1, 2, 5 and 6, a discharge hole 37A having a rectangular shape for discharging the exhaust gas from the second expansion chamber 32 is provided at a sloping surface 37*a*, which is formed at the lower tapered portion of the outer wall panel 37 remote from the side where the engine 1 is located. A spark arrester screen 72 made of stainless steel mesh is installed over the discharge hole 37A from inside. Furthermore, a container-like (triangular in cross-section) inner space-forming member 81 is mounted so as to cover from inside the discharge hole 37A and the spark arrester screen 72. As a result, the exhaust gas that has been introduced into the second expansion chamber 32 is caused to enter into the inner space 80 through the outlet ports 82, which are formed on both side-walls of the inner space-forming member 81, so as to prevent the exhaust gas introduced into the second expansion chamber 32 from being linearly and directly discharged to the outer atmosphere. The exhaust gas is then discharged to the outside of the slanting surface of the outer wall panel 37 after passing through the spark arrester screen 72 and the discharge hole 37A.

The inner space-forming member 81 is fixed to the inner wall of the outer wall panel 37 by means of welding after a sheet metal blank punched in the form of a development elevation is set up as in the case of a foldable box. Predetermined juncture portions are sealed by means of welding, for instance, so as to fabricate the inner space-forming member 81.

Figure 2:
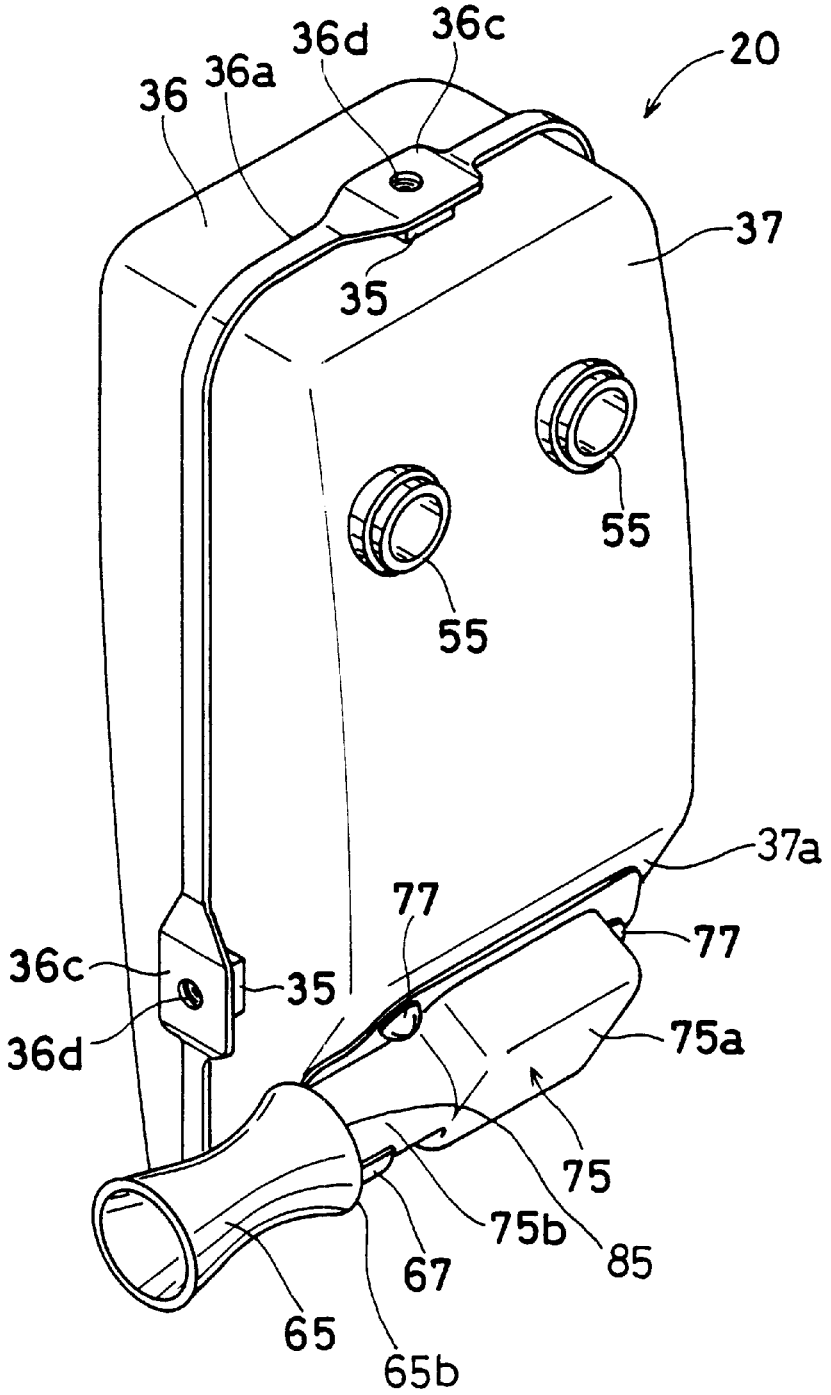
FIG. 2 is a perspective view of the muffler shown in FIG. 1.
Figure 3:
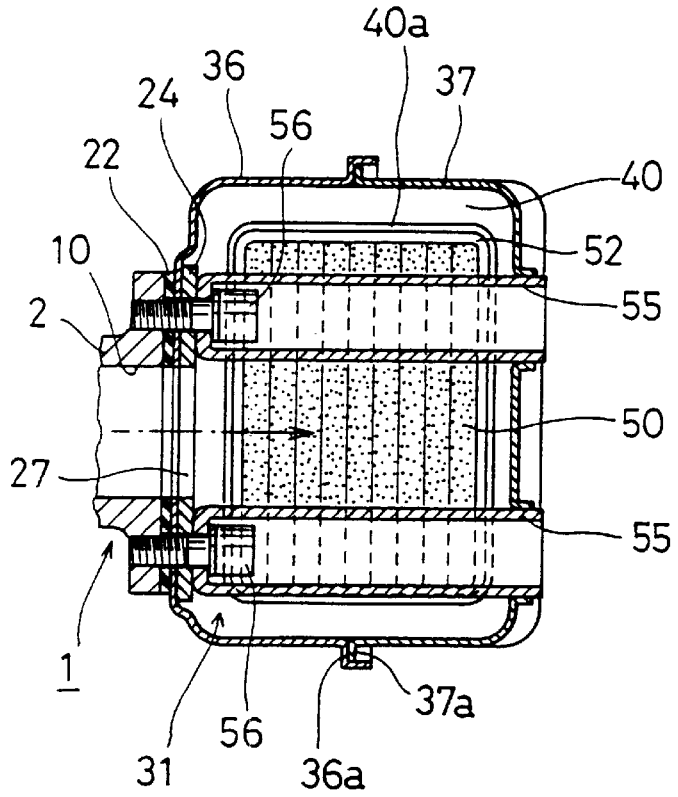
FIG. 3 is a cross-sectional view taken along the line III—III of FIG. 1.
Figure 4:
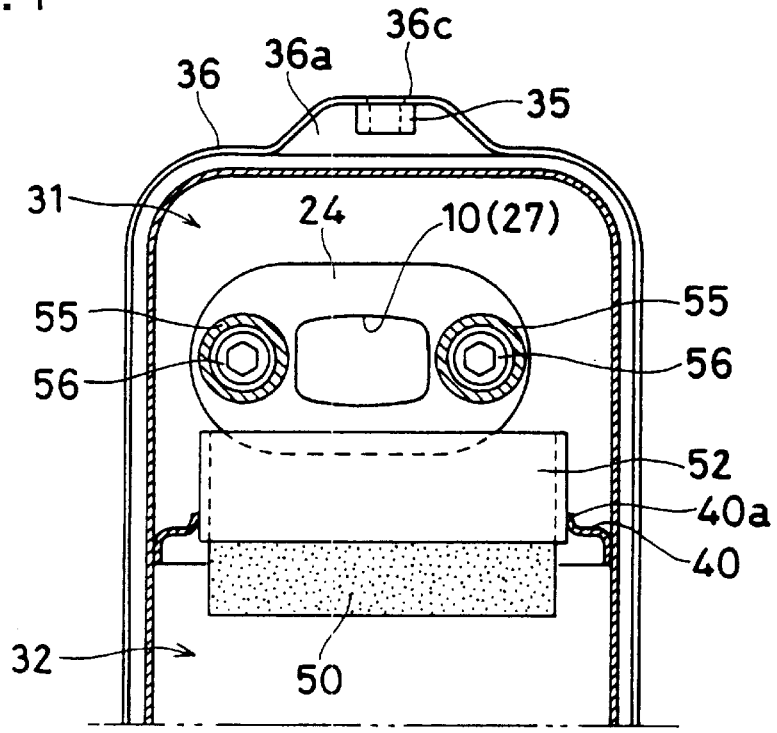
FIG. 4 is a cross-sectional view taken along the line IV—IV of FIG. 1.
Figure 5:
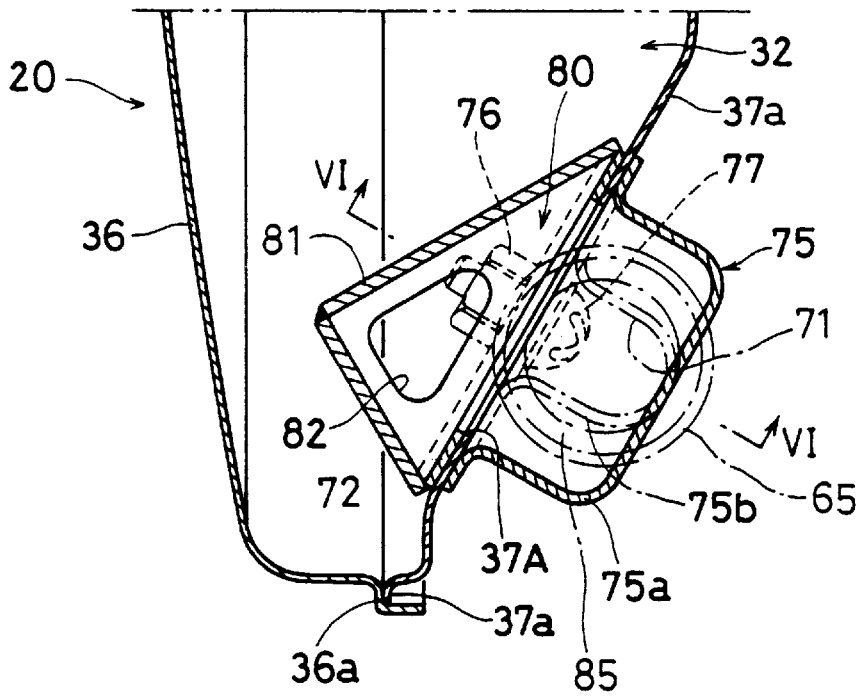
FIG. 5 is an enlarged sectional view illustrating the exhaust gas discharge port region of the muffler shown in FIG. 1.
Figure 6:
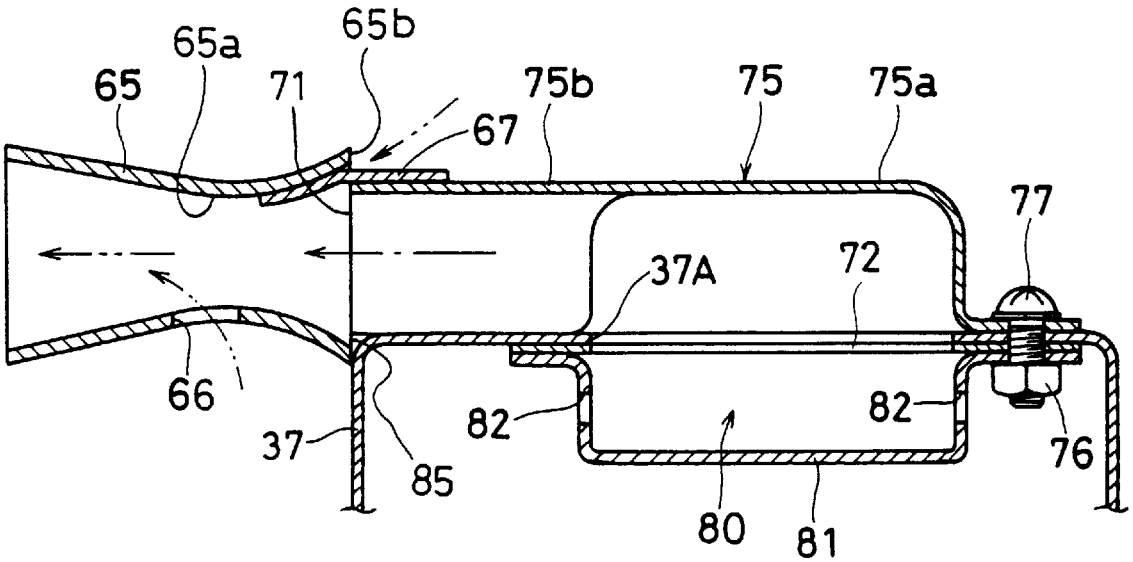
FIG. 6 is a cross-sectional view taken along the line VI—VI of FIG. 5.

As seen from FIGS. 2, 5 and 6, an exhaust gas-guiding member 75 having a final discharge port 71 is mounted on the outer surface of the slanting surface 37*a* of the outer wall panel 37 so as to cover the discharge hole 37A and the spark arrester screen 72.

A nut 76 is fixed by means of welding to each of three portions of the inner surface (back surface) of the peripheral portion of the discharge hole 37A formed in the outer wall panel 37 (see FIG. 6). The exhaust gas-guiding member 75 and the spark arrester screen 72 are fastened together using screws 77 which are engaged from outside with the nuts 76 with the outer wall panel 37 being sandwiched therebetween (FIG. 6).

The exhaust gas-guiding member 75 is a box-like main body 75*a* having a rectangular cross-sectional configuration that is slightly larger than the discharge hole 37A, the bottom face and one side face thereof being opened, and a discharge passage portion 75*b* communicating with the opened side face of the box-like main body 75*a*, thus forming a projected configuration whose bottom face and one side face are both open. The final discharge port 71 of exhaust gas in the muffler 20 is constituted by the open outer end portion of the discharge passage portion 75*b* (FIG. 6).

A Venturi tube 65, both ends of which are enlarged to have a slightly larger diameter than the opening of the final discharge port 71, is connected via an elongated plate-like bracket 67 with the final discharge port 71 of the exhaust gas-guiding member 75, thereby allowing the exhaust gas discharged from the final discharge port 71 to be introduced into the Venturi tube 65.

An air inlet hole 66 is formed at the throat portion 65*a* of the Venturi tube 65 (see FIG. 6). Further, an air inlet space 85 is formed annularly between the edge portion 65*b* of the Venturi tube 65 and the final discharge port 71.

In the muffler 20 of the embodiment described above, the exhaust gas ejected from the exhaust port 10 of the internal combustion engine 1 is introduced into the first expansion chamber 31 at a high speed almost equivalent to the sonic velocity and the exhaust gas thus introduced into the first expansion chamber 31 is then expanded and diffused in the first expansion chamber 31, thereby attenuating the exhaust sound. In this case, almost the entire quantity of exhaust gas that has been ejected into the first expansion chamber 31 is caused to impinge against the outer wall panel portion (the outer wall panel 37) defining the first expansion chamber 31 that is faced to the exhaust port 10, and the exhaust gas thus impinged is then directed toward the oxidation catalyst 50 functioning as an exhaust emission purifier.

Accordingly, it is possible to prevent the exhaust gas ejected from the exhaust port 10 of the internal combustion engine 1 from directly impinging upon the oxidation catalyst 50 and to uniformly introduce all of the exhaust gas toward the inlet side of the oxidation catalyst 50. Further, since the expansion chamber consisting of the first expansion chamber 31 and the second expansion chamber 32 is elongated as a whole in a direction parallel to the longitudinal axis X—X of the cylinder 2, the degree of freedom in the arrangement of the oxidation catalyst 50 can be increased. Further, since the oxidation catalyst 50 is located away from the exhaust port 10 by a predetermined distance in a direction orthogonal to an ejecting flow direction of the exhaust gas from the exhaust port 10, the oxidation catalyst 50 can be positioned at an optimal location. As a result, the temperature distribution of the inlet side of the oxidation catalyst 50 can be made more uniform and, at the same time, the temperature thereof can be made optimal for the activation of the oxidation catalyst 50. Moreover, since the oxidation catalyst 50 can be positioned at an optimal location, it is possible to lower not only the outlet temperature of the exhaust gas but also the surface temperature of the muffler 20 that might otherwise be caused to increase due to the heating of the oxidation catalyst 50, thus minimizing the deterioration of the oxidation catalyst 50 and enhancing the durability of the oxidation catalyst 50.

The exhaust gas introduced into the first expansion chamber 31 passes through the oxidation catalyst 50 that is mounted in the partitioning member 40 and enters the second expansion chamber 32 owing to a difference in pressure between the first expansion chamber 31 and the second expansion chamber 32, which is arranged below the first expansion chamber 31 with the partitioning member 40 being interposed therebetween.

Inasmuch as the exhaust gas is allowed to react (oxidative combustion) effectively with the oxygen in the expansion chambers 31 and 32 due to the effect of the oxidation catalyst 50, the CO and HC components contained in the exhaust gas are greatly reduced.

The exhaust gas introduced into the second expansion chamber 32 is caused to expand and disperse again, thereby further attenuating the exhaust gas noise, and then discharged to the outer atmosphere after passing through the outlet port 82 formed in the inner space-forming member 81, the discharge port 37A covered by the spark arrester screen 72, the exhaust gas-guiding member 75 and the Venturi tube 65. Since the inner space-forming member 81 and the spark arrester screen 72 are arranged in this manner in this case, even if a spark is left unextinguished in the second expansion chamber 32, it is possible to completely prevent the spark from being directly discharged outside, and at the same time, the temperature of the exhaust gas being discharged to the outer atmosphere can be further lowered. As a result, the durability of the spark arrester screen 72 can be improved and, at the same time, the clogging of the spark arrester screen 72 can be minimized.

When the exhaust gas is discharged to the outer atmosphere from the final discharge port 71 of the exhaust gas-guiding member 75 through the Venturi tube 65, the external air is allowed to enter from the air inlet hole 66 formed in the Venturi tube 65 as well as from the annular air inlet space 85 formed between the edge portion 65*b* of the venturi tube 65 and the final discharge port 71 so as to be mixed with the exhaust gas. As a result, the final discharge temperature of the exhaust gas can be further lowered.

Additionally, since the exhaust gas as well as the outer surface of the muffler 20 can be maintained low in temperature, it is no longer required to employ a special heat resistant material, such as stainless steel, which is especially designed for a high temperature muffler in the fabrication of the outer wall panels 36 and 37 constituting the muffler 20, thus making the present invention advantageous in terms of lower cost and easier manufacture.

Figure 7:
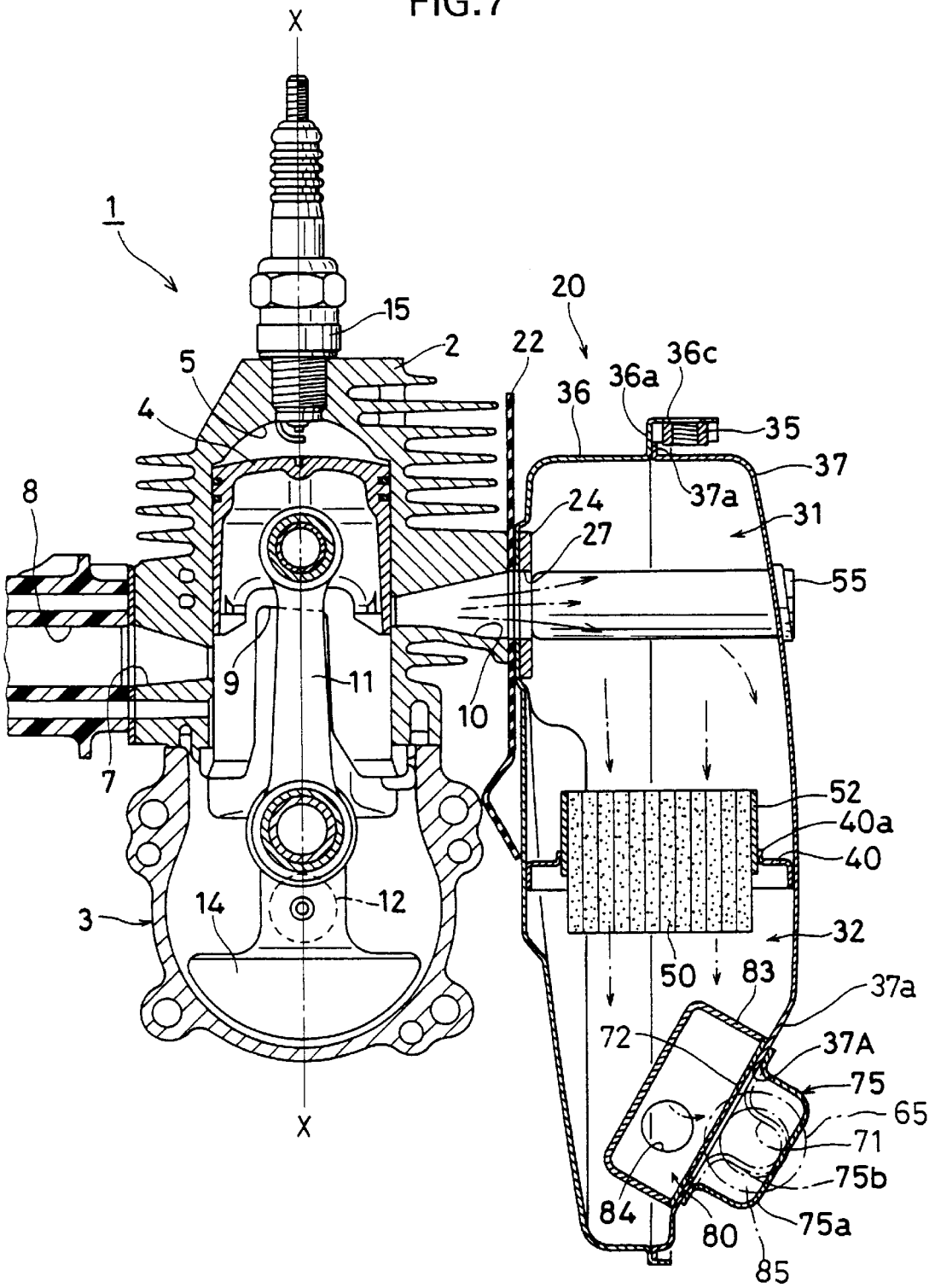
FIG. 7 is a longitudinal cross-sectional view illustrating another embodiment of a muffler according to the present invention, along with an internal combustion engine to which the muffler is attached.
Figure 8:
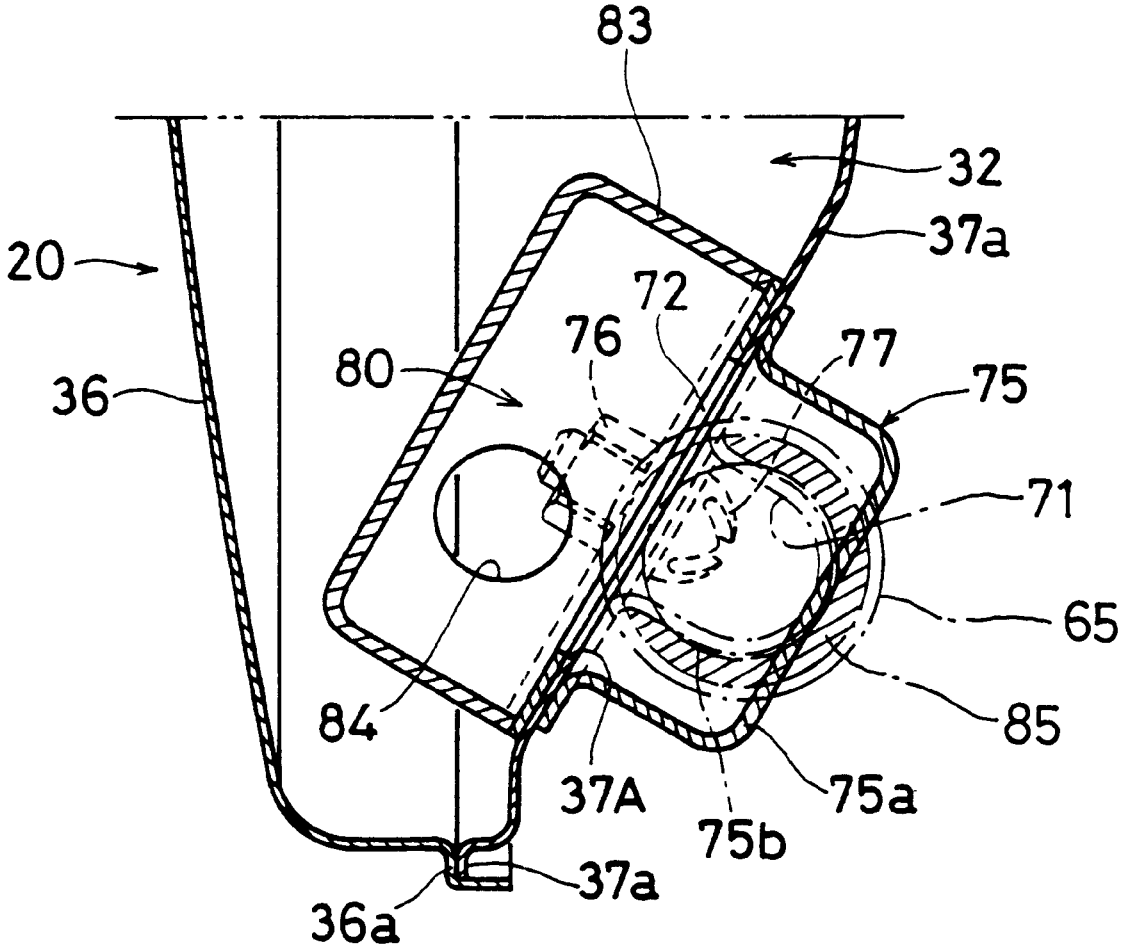
FIG. 8 is an enlarged sectional view illustrating the exhaust gas discharge port region of the muffler shown in FIG. 7.

FIGS. 7 and 8 illustrate another embodiment of a muffler for an internal combustion engine according to the present invention. The muffler 20 of this embodiment is the same as that of FIGS. 1 to 6 set forth above with respect to the fundamental construction and external appearance, but differs in that the position of the partitioning member 40 and the oxidation catalyst 50 are lower (spaced away from the exhaust port 10 by a distance of about 30 mm), thereby keeping them away from the exhaust port 10 so as to prevent the temperature of the inlet side of the oxidation catalyst 50 from becoming higher than that required for the oxidation reaction. As a result, the temperature of exhaust gas at the outlet side of the oxidation catalyst 50 can be lowered, thus making it possible to lower the temperature of the exhaust gas discharged from the muffler 20. Further, since the volume of the first expansion chamber 31 can be increased, the back pressure can be lowered and hence the stability at the working engine speed region can be improved. Also, since a box-like inner space-forming member 83 is employed in place of the triangular (in cross-section) inner space-forming member 81, the inner volume thereof can be increased, thus enabling the box-like inner space-forming member 83 to act as a third expansion chamber, the noise-suppressing effect of the muffler 20 can be enhanced and, at the same time, the stability of the engine speed can be further improved.

The inner space-forming member 83 can be prepared also from a sheet metal which is punched in the form of a development elevation and then set up as in the case of a foldable box, the predetermined junction portions thereof being sealed subsequently by means of welding for instance so as to fabricate the inner space-forming member 83 provided with outlet ports 84 at both sides thereof.

Figure 9:
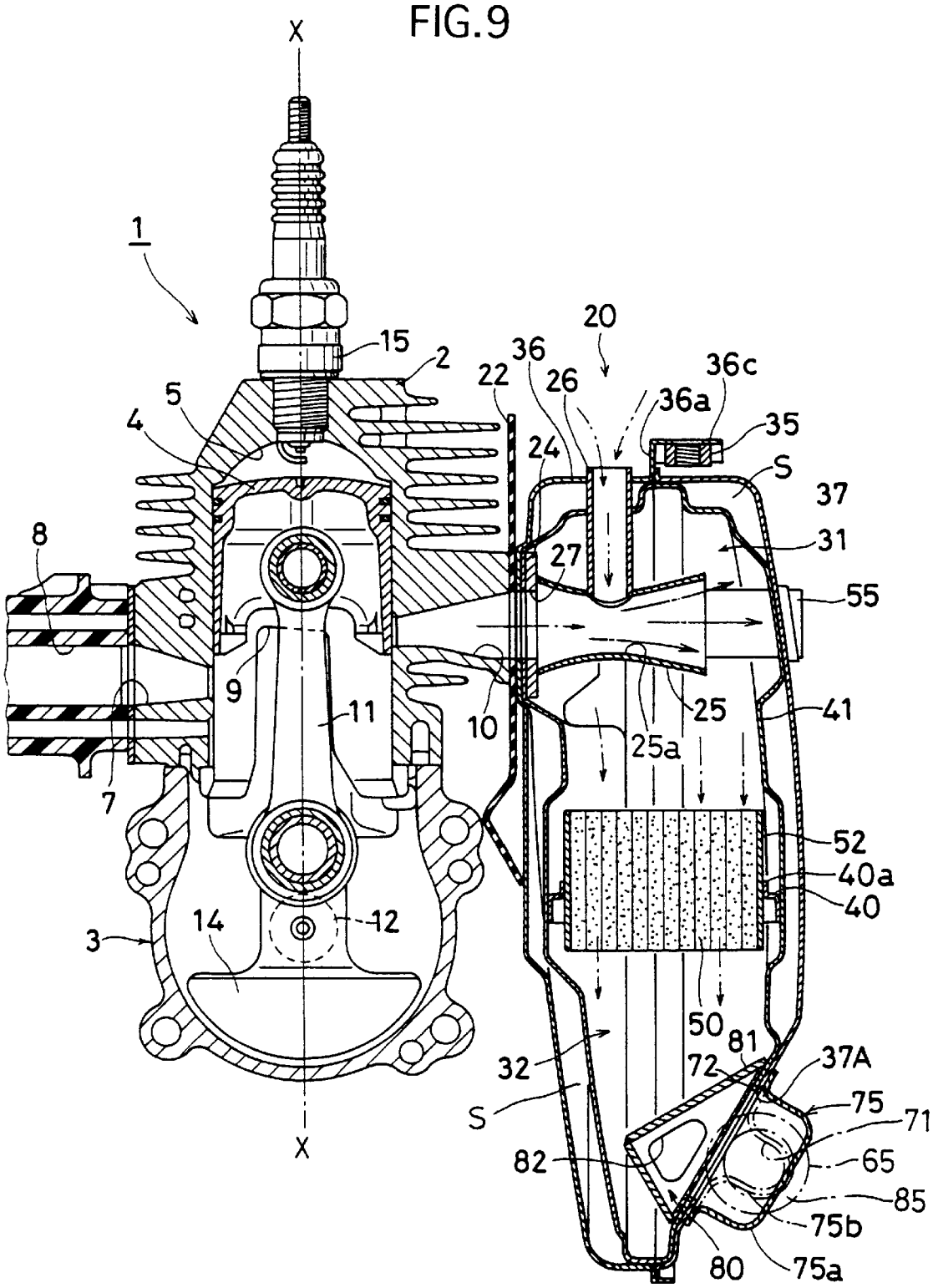
FIG. 9 is a longitudinal cross-sectional view illustrating another embodiment of a muffler according to the present invention, and an internal combustion engine to which the muffler is attached.
Figure 10:
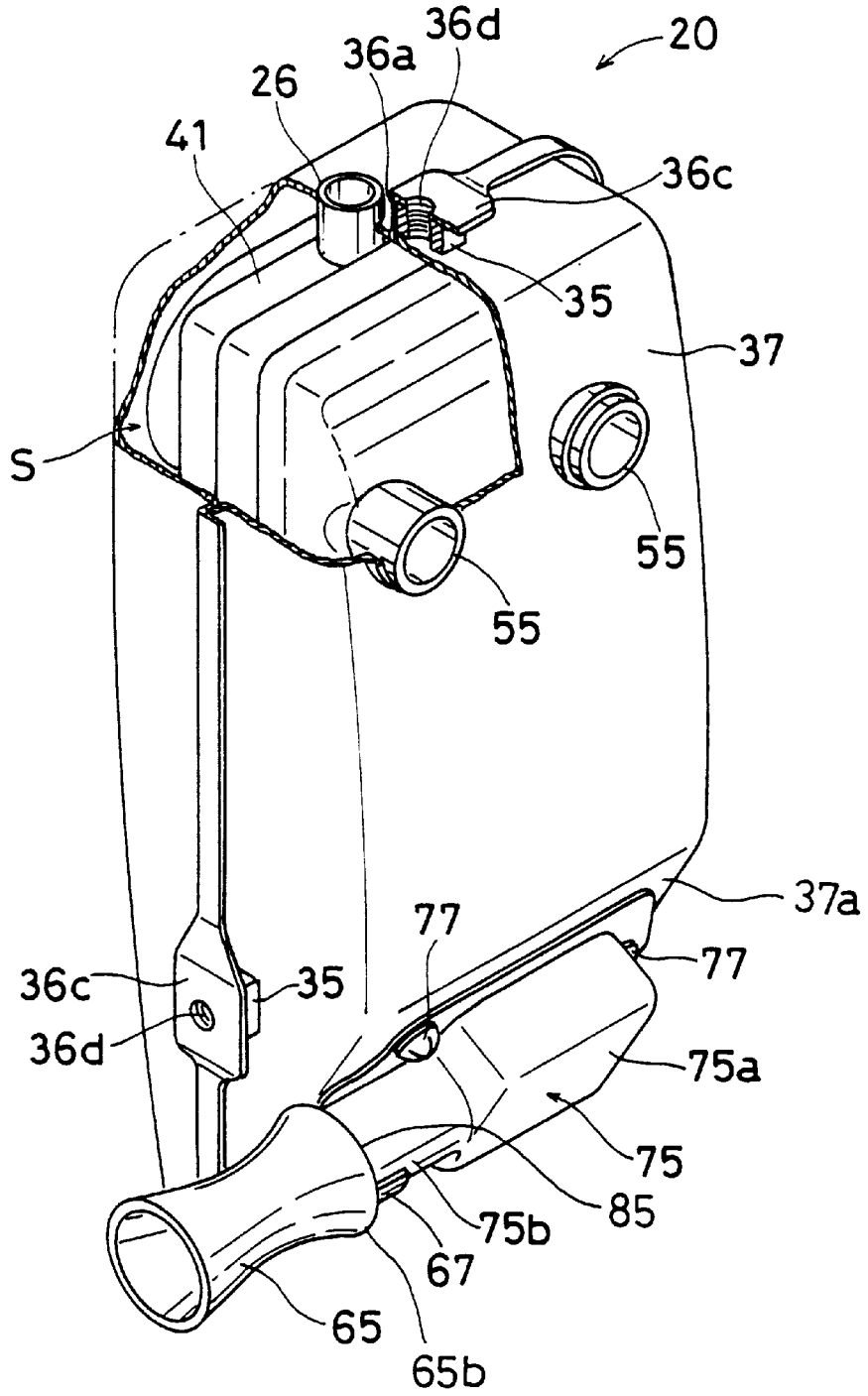
FIG. 10 is a partially sectioned perspective view of the muffler shown in FIG. 9.

FIGS. 9 and 10 illustrate still another embodiment of a muffler for an internal combustion engine according to the present invention. The muffler 20 of FIGS. 9 and 10 is the same as the embodiment of FIGS. 1 to 8 with respect to the fundamental construction and external appearance, but differs in that (1) an inner wall panel 41 is disposed on the inner side of the outer wall panels 36 and 37, thereby to form a heat-insulating space S between the outer wall panels 36 and 37 and the inner wall panel 41, and in that (2) a Venturi tube 25 that services as an outside air inlet means is arranged in the vicinity of the exhaust gas inlet portion 27 of the first expansion chamber 31, thereby allowing the exhaust gas to pass through the Venturi tube 25 so as to induct outside air into the first expansion chamber 31 by taking advantage of the jet flow of the exhaust gas being introduced. An outside air inlet tube 26 communicates the throat portion 25*a* of the Venturi tube 25 with outer atmosphere.

The muffler 20 of FIGS. 9 and 10, in addition to the effects that can be obtained in the aforementioned embodiments, permits further lowering of the temperature of the outer surface of muffler 20 due to the provision of the heat-insulating space S and promotes the oxidation of CO and hence a large reduction of the CO component as the quantity of oxygen inside the first expansion chamber 31 can be increased due to the introduction of outside air through the air inlet tube 26 and the Venturi tube 25.

While the foregoing description and the accompanying drawings of embodiments of the present invention have been described and shown in detail for the purpose of illustration, it will be understood that the construction of the muffler can be varied without departing from the spirit and scope of the invention.

The muffler according to the present invention can be applied not only to the air-cooled two-stroke gasoline engine of the aforementioned embodiments but also to a four-stroke engine. As for the exhaust emission purifier 50, not only those explained above, but also a foamed molded body, a ceramic carrier, and the like can be employed. With regard to the mounting of the oxidation catalyst 50 in the partitioning member 40, various methods such as a method wherein the exhaust emission purifier 50 is made adhesive to the partitioning member 40 can be adopted.

As explained above, it is possible according to the present invention to provide a muffler for an internal combustion engine, which is capable of preventing the exhaust gas ejected from the exhaust port of an internal combustion engine from directly impinging against the exhaust emission purifier due to poor dispersion of the exhaust gas, capable of making the temperature distribution on the inlet side of the exhaust emission purifier uniform as a whole so as to optimize the temperature of this region for the activation of the exhaust emission purifier, and capable of lowering not only the outlet temperature of the exhaust gas but also the surface temperature of the muffler that might otherwise be caused to increase due to the heating of the exhaust emission purifier, thus minimizing the deterioration of the exhaust emission purifier and enhancing the durability of the exhaust emission purifier.

What is claimed is:

1. In a muffler for an internal combustion engine, the muffler having an expansion chamber into which an exhaust gas ejected from an exhaust port of the internal combustion engine is introduced, the improvement wherein the expansion chamber includes a partition plate separating the expansion chamber level-wise with respect to a longitudinal axis of a cylinder of the internal combustion engine into a first expansion chamber and a second expansion chamber;

the exhaust port communicates with the first expansion chamber, and an exhaust emission purifier is attached to the partition plate such that exhaust gas ejected from the exhaust port into the first expansion chamber is introduced into the second expansion chamber from the first expansion chamber via the exhaust emission purifier;

wherein the second expansion chamber is defined by an outer wall panel, and the outer wall panel has a discharge port for the exhaust gas, the discharge port being covered from inside by a container-like inner space-forming member, the inner space-forming member having an opening to the second expansion chamber, said opening being substantially orthogonal to said discharge port and to the direction of exhaust gas being introduced into the second expansion chamber from the exhaust emission purifier, thereby allowing the exhaust gas introduced into the second expansion chamber to be discharged from the second expansion chamber to the outside atmosphere through an outlet port formed in the inner space-forming member and through the discharge port.

2. The muffler according to claim 1, wherein the expansion chamber is elongated in a direction generally parallel to the longitudinal axis of the cylinder.

3. The muffler according to claim 1, wherein the exhaust emission purifier is spaced apart from the exhaust port by a predetermined distance in a direction orthogonal to an ejecting direction of the exhaust gas.

4. The muffler according to claim 1, wherein the exhaust emission purifier is an oxidation catalyst.

5. The muffler according to claim 1, wherein the discharge port is covered by a spark arrester screen.

6. The muffler according to claim 1, further comprising an outer exhaust gas-guiding member covering the discharge port from the outside, the outer exhaust gas-guiding member having a discharge passage and a venturi tube through which the exhaust gas is discharged to the outside atmosphere.

* * * * *